United States Patent [19]

Horodysky

[11] Patent Number: 4,657,684

[45] Date of Patent: Apr. 14, 1987

[54] MULTIFUNCTIONAL ANTIWEAR ADDITIVES AND COMPOSITIONS THEREOF

[75] Inventor: Andrew G. Horodysky, Cherry Hill, N.J.

[73] Assignee: Mobil Oil Corporation, New York, N.Y.

[21] Appl. No.: 746,484

[22] Filed: Jun. 19, 1985

[51] Int. Cl.[4] ..... C10M 129/00; C10M 137/00

[52] U.S. Cl. ..... 252/32.5; 252/49.9; 548/112

[58] Field of Search ..... 252/49.9, 32.5; 548/112, 347

[56] References Cited

U.S. PATENT DOCUMENTS 3,192,162 6/1965 Bartlett et al. ..... 252/46.6

4,375,417 3/1983 Zoleski et al. ..... 252/33.4

*Primary Examiner*—Ferris H. Lander

*Attorney, Agent, or Firm*—Alexander J. McKillop; Michael G. Gilman; Howard M. Flournoy

[57] ABSTRACT

Internal oxazoline acid phosphates provide effective antiwear and friction reducing characteristics for lubricant compositions when incorporated therein.

16 Claims, No Drawings

MULTIFUNCTIONAL ANTIWEAR ADDITIVES AND COMPOSITIONS THEREOF

BACKGROUND OF THE INVENTION

This invention is directed to lubricant compositions containing small additive concentrations of reaction products which possess excellent multifunctional antiwear and friction modifying activity. This invention is also directed to such additives as novel compositions of matter.

The need for antiwear or friction reducing modifiers in lubricating oils to meet the ever changing requirements of modern engines is well known. Various materials and various techniques have been proposed.

The use of oxazolines is known for their surfactant and lubricity properties when formulated into lubricating oils and for their water scavenging and dispersant characteristics when blended into fuels.

The use of phosphorus containing lubricating additives has also found widespread use. Phosphonates have been found to be lubricity and antiwear agents as exemplified by U.S. Pat. No. 4,356,097 which describes the use of dihydrocarbyl phosphonates and lubricant formulations.

U.S. Pat. No. 3,920,567 describes quaternary salts formed as the reaction product of an alkyl phosphonate and a hydroxyalkyl oxazoline as useful antiwear and extreme pressure agents in lubricating oils.

In accordance with the present invention the use of novel zwitterionic (internal) acid phosphate salts of oxazolines in lubricants provides effective antiwear activity, and friction reducing characteristics. Furthermore these unique internal oxazoline-derived acid phosphates not only provide greater antiwear activity than traditional acid oxazolines but have greater potential friction reducing activity than previously reported with prior art acid phosphates. The exceptional surface activity of these novel additives, coupled with the oxazoline moiety, apparently provide the basis for the significant synergistic friction-reducing activity.

DESCRIPTION OF THE PREFERRED EMBODIMENTS

The oxazolines in accordance with the present invention have the following generalized structure:

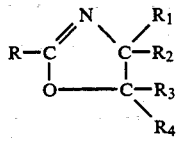

wherein R is from about $C_8$ to about $C_{30}$ hydrocarbyl, or R is an acyl sarcosine-derived group consisting of

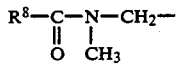

where $R^8$ is from about $C_8$ to about $C_{30}$ hydrocarbyl, at least one of $R_1$, $R_2$, $R_3$ and $R_4$ is hydroxyalkyl having from 1 to about 6 carbon atoms and the remaining $R_1$, $R_2$, $R_3$ and $R_4$ are independently selected from the group consisting of $C_1$ to about $C_{30}$ hydrocarbyl, $C_1$ to about $C_6$ hydroxyalkyl, hydrogen or

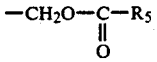

where $R_5$ is hydrogen or $C_1$ to about $C_{30}$ hydrocarbyl, or

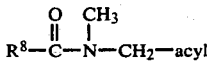

sarcosine-derived grouping.

The above hydroxyalkyl hydrocarbyl or acyl sarcosine-derived oxazolines are converted to their corresponding acid phosphates by reaction with molar quantities, more than molar quantities, or less than molar quantities of phosphorus pentoxide. Preferably the reaction takes place with up to substantially molar quantities of $P_2O_5$ at temperatures of from about 50° to 130° C. wherein the $P_2O_5$ is added incrementally as the reactor temperature is increased. The reaction takes approximately 4–12 hours or more. Although depending upon the reactants and reaction parameters, the reaction may be completed in less than about 10 hours. A mixture of products is believed to form during the reaction with phosphorus pentoxide and at least a portion contains the zwitterionic internal oxazoline acid phosphate salt having the below generalized structure:

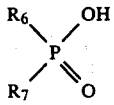

wherein at least one of $R_6$ and $R_7$ or both are derived from a hydroxyalkyl oxazoline moiety as described herein and the other $R_6$ or $R_7$ is each independently selected from $C_1$ to about $C_6$ hydrocarbyl and hydroxyl. Mixtures of corresponding mono- and di-acid phosphate salts are believed to be formed.

A preferred hydrocarbyl oxazoline is prepared by the reaction of oleic acid and stearic acid with tris-(hydroxymethyl) aminomethane. With the use of equimolar quantities of the reagents dihydroxyalkyl oxazolines are formed. With the use of 2 moles of acid hydroxyalkyl oxazoline esters are formed. Either of them or mixtures can be used in the invention. Nevertheless, the oxazolines in accordance herewith may be obtained commercially or by any process or reaction known to the art.

A preferred acyl sarcosine-derived oxazoline can be prepared by the reaction of oleoyl sarcosine with tris-(hydroxymethyl) aminomethane. Said sarcosines can also include lauroyl sarcosine, cocoyl sarcosine, tallowyl sarcosine and similar sarcosines or mixtures of such sarcosines. Also mixtures of sarcosines and fatty acids can be used to prepare said oxazolines. Oxazolines derived from sarcosines or mixtures containing sarcosines are often preferred.

The described zwitterionic or oxazoline-derived internal acid phosphates may be further reacted with an amine to yield an oxazoline acid phosphate amine. Any suitable hydrocarbyl amine may be used as exemplified by stearylamine, oleoylamine, tallowamine, cocoamine, t-alkyl primary amines, or diamines such as n-oleyl-1,3-propylene diamine, or etheramines or ether diamines such as triisodecyloxypropylamine.

The additives embodied herein are utilized in lubricating oil or grease compositions in an amount which imparts significant antiwear characteristics to the oil or grease as well as reducing the friction of engines operating with the oil in its crankcase. Concentrations of about 0.001 to about 10 wt.% based on the total weight of the composition can be used. Preferably, the concentration is from about 0.1 to about 3 wt.%. It is expected that these materials would also be suitable for use in liquid hydrocarbyl fuel compositions.

The additives have the ability to improve the antiwear characteristics and friction reducing characteristics of various oleaginous materials such as hydrocarbyl lubricating media which may comprise liquid oils in the form of either a mineral oil or a synthetic oil, or in the form of a grease in which the aforementioned oils are employed as a vehicle.

In general, mineral oils, both paraffinic, naphthenic and mixtures thereof, employed as the lubricant, or grease vehicle, may be of any suitable lubricatinq viscosity range, as for example, from about 45 SSU at 100° F. to about 6000 SSU at 100° F., and preferably, from about 50 to about 250 SSU at 210° F. These oils may have viscosity indexes ranging to about 100 or higher. Viscosity indexes from about 70 to about 95 are preferred. The average molecular weights of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation.

A wide variety of materials may be employed as thickening or gelling agents. These may include any of the conventional metal salts or soaps, which are dispersed in the lubricating vehicle in grease-forming quantities in an amount to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects, any materials which is normally employed for thickening or gelling hydrocarbon fluids for forming grease can be used in preparing grease in accordance with the present invention.

In instances where synthetic oils, or synthetic oils employed as the vehicle for the grease, are desired in preference to mineral oils, or in combination therewith, various compounds of this type may be successfully utilized. Typical synthetic vehicles include, but are not limited to, polyisobutylene, polybutenes, hydrogenated polydecenes, polypropylene glycol, polyethylene glycol, trimethylolpropane esters, neopentyl and pentaerythritol esters, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes), alkyl-substituted diphenyl ethers typified by a butyl-substituted bis (p-phenoxy phenyl) ether, phenoxy phenylethers.

It is to be understood, however, that the compositions contemplated herein can also contain other materials. For example, corrosion inhibitors, extreme pressure agents, viscosity index improvers, co-antioxidants, other antiwear agents and the like can be used as exemplified respectively by metallic phenates of sulfonates, polymeric succinimides, metallic phosphorodithioates and the like. These materials do not detract from the value of the compositions of this invention, rather the materials serve to impart their customary properties to the particular compositions in which they are incorporated.

The following examples illustrate the invention. They are illustrative only and are not meant to limit it.

EXAMPLE 1

Approximately 175g of a hydrocarbyl oxazoline (prepared by the reaction of 0.95 moles oleic acid, and 0.05 moles stearic acid with 1.00 moles tris(hydroxymethyl) aminomethane until dehydration was complete at about 180° C.) and 100ml n-hexane was placed into a reactor and warmed to about 60° C. under $N_2$ blanket. Approximately 24g phosphorus pentoxide was added incrementally over two hours at 60°–70° C. The reactants were heated at about 65°–85° C. for five additional hours and at 95°–98° C. for three more hours. The solvent was removed by vacuum distillation and the unreacted solids were removed by filtration. The product contained about 0.7% phosphorus.

EXAMPLE 2

The general reaction scheme of Example 1 was followed, but 48g of phosphorus pentoxide was added to 175g of the oxazoline of Example 1 and 100ml n-hexane. After a two hour addition period at about 60°–70° C., the mixture was agitated at 65°–75° C. for four hours and for three hours at 95°–98° C. The solvent was removed by distillation and the unreacted solids were removed by filtration. The product contained about 1.8% phosphorus.

EXAMPLE 3

Approximately 175g of an acyl sarcosine-derived oxazoline (prepared by the reaction of 1.0 moles oleyl sarcosine with 1.0 mole tris(hydroxymethyl) aminomethane until dehydration was complete at about 180° C.) and 100 ml n-hexane was placed into a reactor and warmed to about 60° C. under the blanket. Approximately 12.5 g of phosphorus pentoxide was added incrementally over two hours at 60°–70° C. The reactants were heated at temperatures up to 130° C. for approximately 4 additional hours. Approximately 175 g of a 100′ solvent paraffinic neutral process oil was added to reduce viscosity and improve handling. The solvent was removed by vacuum distillation and the product was filtered through diatomaceous earth.

Evaluation of the Reaction Products

The products of the examples were blended into mineral oil at 1% concentration and evaluated in the Shell Four-Ball Wear Test using a 60 kg load at 1500 RPM for thirty minutes as shown in Table 1.

In the Shell Four-Ball Wear Test, three stationary balls are placed in the lubricant cup and the lubricant containing the compound to be tested is added thereto, and a fourth ball is placed in a chuck mounted on a device which can be used to spin the ball at known speeds and loads. The samples were tested using ½ inch stainless steel balls of 52100 steel for 30 minutes.

TABLE 1

| Four-Ball Wear Test Results | | | |
|---|---|---|---|
| | Concentration in Base Oil, Wt. % | Scar Diameter, MM (60 kg load, 1500 RPM, 30 Minutes) 175° F. | 275° F. |
| Base Oil | — | 1.98 | 2.23 |
| Example 1 | 1.0 | 0.60 | 0.85 |
| Example 2 | 1.0 | 0.50 | 0.45 |

The results clearly demonstrate the antiwear effectiveness of the compositions, especially Example 2 which contains a greater amount of the phosphate moiety.

The products, blended into a fully formulated atuomotive engine oil, were also evaluated for friction reducing properties using the Low Velocity Friction Apparatus and procedure (LVFA) which is described in U.S. Pat. Nos. 4,511,482 and 4,486,321.

TABLE 2

| Frictional Characteristics | | | |
|---|---|---|---|
| | Additive Concentration Wt. % | % Reduction in Coefficient of Friction 5 Ft/Min | 30 Ft/Min |
| Base Oil (fully formulated synthetic engine oil containing detergent/dispersant/inhibitor performance package) SAE low-30 | | 0 | 0 |
| Example 2 | 1.0 | 9 | 17 |
| Example 3 | 2.0 | 18 | 16 |

The results clearly demonstrate the friction reducing properties of the compositions evaluated.

The data disclosed in the Tables clearly demonstrate the antiwear effectiveness and the friction reducing properties of the compositions which contain the internal acid phosphate salts described herein. They are useful at low concentrations, are ashless and do not contain any potentially undesirable sulfur or metallic salts. They may be readily prepared in a two-step one-pot process, comparable in many respects to known reactions currently practiced commercially.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A composition comprising a major proportion of an oil of lubricating viscosity or grease prepared therefrom and a minor antiwear or friction reducing proportion of an oxazoline derived internal acid phosphate prepared by reacting a hydroxyalkyl hydrocarbyl oxazoline having the following generalized structure with phosphorus pentoxide

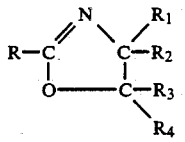

wherein R is from about $C_8$ to about $C_{30}$ hydrocarbyl, or R is an acyl sarcosine-derived group consisting of

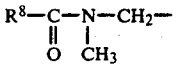

where $R^8$ is from about $C_8$ to about $C_{30}$ hydrocarbyl, and at least one of $R_1$, $R_2$, $R_3$ and $R_4$ is hydroxyalkyl having from 1 to about 6 carbon atoms and the remaining $R_1$, $R_2$, $R_3$ and $R_4$ are independently selected from the group consisting of $C_1$ to about $C_{30}$ hydrocarbyl, $C_1$ to about $C_6$ hydroxyalkyl, hydrogen or

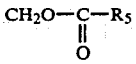

where $R_5$ is hydrogen or $C_1$ to about $C_{30}$ hydrocarbyl, or

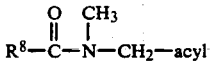

sarcosine-derived grouping.

2. The composition of claim 1 wherein the reaction is carried out at temperatures of from about 50° to about 110° C. with less than, more than or substantially molar quantities of phosphorous pentoxide.

3. The composition of claim 2 wherein the phosphorus pentoxide is added incrementally at temperatures ranging from about 55° to about 75° C.

4. The composition of claim 1 wherein the reaction is carried out over a period of about ten hours or less.

5. The composition of claim 1 wherein said internal acid phosphate has the following generalized structure:

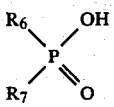

wherein at least one of $R_6$ and $R_7$ or both is derived from a hydroxyalkyl oxazoline moiety as described in claim 1 and the other $R_6$ or $R_7$ is each independently selected from $C_1$ to about $C_6$ hydrocarbyl and hydroxyl.

6. The composition of claim 1 wherein said major proportion is selected from the group consisting of mineral oils, synthetic oils or mixtures thereof.

7. The composition of claim 6 wherein said major proportion is a mineral oil.

8. The composition of claim 6 wherein said major proportion is a synthetic oil.

9. The composition of claim 6 wherein said major proportion is a grease.

10. The composition of claim 1 wherein the oxazoline derived acid phosphate is further reacted with an amine selected from the group consisting of a hydrocarbyl amine, hydrocarbyl diamine, ether amine or ether diamine.

11. An additive product consisting of an oxazoline derived internal acid phosphate prepared by reacting a hydroxyalkyl hydrocarbyl oxazoline having the following generalized structure with phosphorus pentoxide

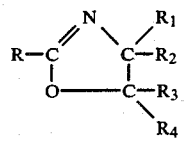

wherein R is from about $C_8$ to about $C_{30}$ hydrocarbyl, or R is an acyl sarcosine-derived group consisting of

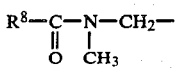

where $R^8$ is from about $C_8$ to about $C_{30}$ hydrocarbyl, at least one of $R_1$, $R_2$, $R_3$ and $R_4$ is hydroxyalkyl having from 1 to about 6 carbon atoms and the remaining $R_1$, $R_2$, $R_3$ and $R_4$ are independently selected from the group consisting of $C_1$ to about $C_{30}$ hydrocarbyl, $C_1$ to about $C_6$ hydroxyalkyl, hydrogen or

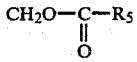

where $R_5$ is hydrogen or $C_1$ to about $C_{30}$ hydrocarbyl, or

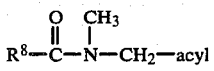

sarcosine-derived grouping.

12. The additive product of claim 11 wherein the reaction is carried out at temperatures of from about 50° to about 110° C. with substantially molar quantities of phosphorous pentoxide.

13. The additive product of claim 12 wherein in the reaction phosphorous pentoxide is added incrementally at temperatures of from about 55° to about 75° C.

14. The additive product of claim 11 wherein said product is at least in part an internal oxazoline acid phosphate having the following generalized structure:

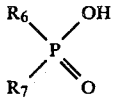

wherein at least one of $R_6$ and $R_7$ or both are derived from a hydroxyalkyl oxazoline moiety as described in claim 1 and the other $R_6$ or $R_7$ is each independently selected from $C_1$ to about $C_6$ hydrocarbyl and hydroxyl.

15. The additive product of claim 11 wherein the product described therein is further reacted with a hydrocarbyl amine, diamine, etheramine or etherdiamine to obtain the corresponding oxazoline derived acid phosphate amine.

16. A compound having the following generalized structure

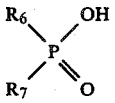

wherein at least one of $R_6$ and $R_7$ or both is derived from a hydroxyalkyl oxazoline moiety as described in claim 1 and the other $R_6$ or $R_7$ is each independently selected from $C_1$ to about $C_6$ hydrocarbyl and hydroxyl.

* * * * *